US012305466B2

(12) United States Patent
Moreno et al.

(10) Patent No.: US 12,305,466 B2
(45) Date of Patent: May 20, 2025

(54) LINER HANGER SYSTEM AND METHOD WITH NON-PRESSURE SENSITIVE ACTUATION

(71) Applicant: Schlumberger Technology Corporation, Sugar Land, TX (US)

(72) Inventors: Juan Pablo Macin Moreno, Rosharon, TX (US); Jose Hurtado, Houston, TX (US); Mikhail Gotlib, Houston, TX (US); George Telfer, Aberdeen (GB); Stephen Lewis, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 450 days.

(21) Appl. No.: 17/758,655

(22) PCT Filed: Jan. 18, 2021

(86) PCT No.: PCT/US2021/013824

§ 371 (c)(1),
(2) Date: Jul. 12, 2022

(87) PCT Pub. No.: WO2021/150458

PCT Pub. Date: Jul. 29, 2021

(65) Prior Publication Data

US 2023/0055946 A1 Feb. 23, 2023

Related U.S. Application Data

(60) Provisional application No. 62/963,334, filed on Jan. 20, 2020.

(51) Int. Cl.
*E21B 43/10* (2006.01)
*E21B 33/04* (2006.01)

(52) U.S. Cl.
CPC ..... *E21B 33/0422* (2013.01)

(58) Field of Classification Search
CPC ..... E21B 23/042; E21B 43/10; E21B 23/01; E21B 23/0411; E21B 34/142; E21B 23/00
See application file for complete search history.

(56) References Cited

U.S. PATENT DOCUMENTS 2,315,931 A * 4/1943 Burt ..... E21B 33/14 166/143
3,117,628 A * 1/1964 Myers ..... E21B 43/10 166/123

(Continued)

FOREIGN PATENT DOCUMENTS

RU 2424423 C1 7/2011
RU 2674781 C1 12/2018

(Continued)

OTHER PUBLICATIONS

First Substantive Exam Report issued in Saudi Arabia Patent Application No. 522433346 dated Apr. 20, 2023, 13 pages with English translation.

(Continued)

*Primary Examiner* — Kipp C Wallace
(74) *Attorney, Agent, or Firm* — Jeffrey D. Frantz

(57) ABSTRACT

A technique facilitates reducing or eliminating the risk of premature actuation of a liner hanger system and/or premature release of a miming tool. According to an embodiment, the technique utilizes a running string for deploying a liner hanger assembly having a liner hanger which may be actuated at a desired location to suspend a liner/casing from a surrounding casing string. An anti-preset module may be used in cooperation with the liner hanger to prevent premature actuation of the liner hanger. By way of example, the anti-preset module may use pressure equalization between a region within the miming string and a region between the miming string and the liner hanger to prevent pressure (Continued)

imbalances which could actuate the liner hanger. Additionally, a locking mechanism, e.g. releasable lock dogs, may be used to temporarily lock the liner hanger against premature actuation.

17 Claims, 8 Drawing Sheets

(56) References Cited

U.S. PATENT DOCUMENTS

| | | | | |
|---|---|---|---|---|
| 4,249,601 | A | 2/1981 | White | |
| 4,828,037 | A | 5/1989 | Lindsey et al. | |
| 5,044,441 | A | 9/1991 | Rubbo et al. | |
| 6,681,860 | B1 | 1/2004 | Yokley et al. | |
| 7,766,088 | B2 | 8/2010 | Saucier et al. | |
| 8,517,114 | B2 | 8/2013 | Nevels et al. | |
| 8,584,765 | B2 | 11/2013 | Slup | |
| 8,893,807 | B2 | 11/2014 | Tait | |
| 9,816,357 | B2 | 11/2017 | Abraham | |
| 9,995,099 | B2 | 6/2018 | Halfmann | |
| 10,012,046 | B2 | 7/2018 | Ewing et al. | |
| 2002/0070032 | A1 | 6/2002 | Maguire et al. | |
| 2010/0038096 | A1* | 2/2010 | Reimert | E21B 23/01 166/208 |
| 2010/0252252 | A1* | 10/2010 | Harris | E21B 23/06 166/120 |
| 2017/0241238 | A1* | 8/2017 | Bacsik | E21B 43/14 |
| 2018/0112480 | A1* | 4/2018 | Allamon | E21B 43/10 |
| 2018/0223615 | A1 | 8/2018 | Luke et al. | |
| 2019/0040699 | A1 | 2/2019 | Perez et al. | |
| 2020/0240224 | A1* | 7/2020 | Saraya | E21B 34/142 |

FOREIGN PATENT DOCUMENTS

| | | | |
|---|---|---|---|
| RU | 2700357 | C1 | 9/2019 |
| WO | 2015054552 | A1 | 4/2015 |

OTHER PUBLICATIONS

International Search Report and Written Opinion issued in the PCT Application PCT/US2021/013824, dated Apr. 22, 2021 (12 pages).

* cited by examiner

LINER HANGER SYSTEM AND METHOD WITH NON-PRESSURE SENSITIVE ACTUATION

CROSS-REFERENCE TO RELATED APPLICATION

The present document is the National Stage Entry of International Application No. PCT/US2021/013824, filed Jan. 18, 2021, which is based on and claims priority to U.S. Provisional Application Ser. No. 62/963,334, filed Jan. 20, 2020, which is incorporated herein by reference in its entirety.

BACKGROUND

In many well applications, a wellbore is drilled and a casing string is deployed along the wellbore. A liner hanger system may then be used to suspend liner/casing downhole within the casing string via a liner hanger. The liner hanger system may be a mechanically operated system or a hydraulically operated system. However, hydraulically operated systems generally have greater versatility and allow the liner to be rotated during running in hole. While running in hole, fluid is circulated downhole under pressure to facilitate deployment of the liner. However, circulating the fluid at higher flow rates can generate high circulating pressures which run the risk of prematurely setting the liner hanger and/or releasing a running tool used to deploy the liner hanger. Attempts have been made to restrict such premature actuation, but current systems can be complicated or may not render the liner hanger system immune from premature hydraulic actuation.

SUMMARY

In general, a methodology and system are provided for reducing or eliminating the risk of premature actuation of a liner hanger system and/or premature release of a running tool. According to an embodiment, the technique utilizes a liner hanger system having a running string and a liner hanger assembly which may include a liner top packer assembly. The liner hanger assembly comprises a liner hanger which may be actuated at a desired location to suspend a liner/casing from a surrounding casing string. The liner hanger system utilizes an anti-preset module which may be used in cooperation with the liner hanger to prevent premature actuation of the liner hanger. By way of example, the anti-preset module may use pressure equalization between a region within the running string and a region between the running string and the liner hanger to prevent pressure imbalances which could actuate the liner hanger. Additionally, a locking mechanism, e.g. releasable dogs, may be used to temporarily lock the liner hanger against premature actuation. The anti-preset module may be used to avoid premature setting of the liner hanger, while pressure equalization inside and outside the hanger running tool, e.g. inside and outside a collet running tool, may be used to avoid premature release of the hanger running tool.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
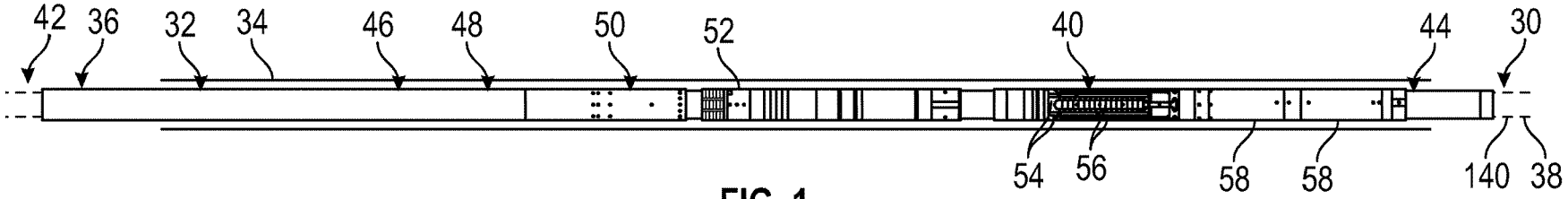
FIG. 1 is an illustration of an example of a liner hanger system being deployed into a borehole, e.g. wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system for reducing or eliminating the risk of premature actuation of a liner hanger system and/or premature release of a running tool. According to an embodiment, the technique utilizes a liner hanger system having a running string and a liner hanger assembly. The liner hanger assembly comprises a liner hanger which may be actuated at a desired location within a borehole, e.g. within a casing. The liner hanger assembly further comprises a liner/casing which may be suspended from a surrounding casing string via the liner hanger.

The liner hanger system utilizes an anti-preset module which may be used in cooperation with the liner hanger to prevent premature actuation of the liner hanger. Additionally, the system may utilize features to avoid premature release of the liner hanger running tool. By way of example, the anti-preset module may use pressure equalization between a region within the running string and a region between the running string and the liner hanger to prevent pressure imbalances which could actuate the liner hanger. Additionally, a locking mechanism, e.g. releasable dogs, may be used to temporarily lock the liner hanger against premature actuation. According to an embodiment, the anti-preset module may be used to avoid premature setting of the liner hanger, while pressure equalization inside and outside the hanger running tool, e.g. inside and outside a collet running tool, may be used to avoid premature release of the hanger running tool.

As described in greater detail below, the system helps enable circulation of fluids at relatively high rates and pressures during deployment of the liner and liner hanger. According to an embodiment, a running string extends into the liner hanger and liner in a manner which creates an inner pressure region within the running string and an intermediate pressure region between the running string and the liner hanger/liner. The configuration of the overall system allows pressure to substantially equalize within both regions. Additionally, the locking mechanism of the anti-preset module is used to mechanically lock the liner hanger against premature actuation. For example, the locking mechanism may be used to mechanically lock a hydraulic cylinder of the liner hanger in a run-in-hole position.

The liner hanger may be set by dropping a ball down through the running tool to a ball seat to thus enable creation of a pressure differential between the inner pressure region and the intermediate pressure region. By relatively increasing the pressure within the inner pressure region, the locking mechanism is released to enable actuation of the liner hanger. In some embodiments, a shear member, e.g. shear screws, also may be used so that pressuring up the running string initially shears the shear screws. Prior to dropping the ball, fluid circulation may be performed at desired rates within the system without risking premature shearing of the shear member or actuation of the liner hanger. Once the ball is dropped to temporarily plug the anti-preset module, however, a pressure differential can be created between the inner pressure region and the intermediate pressure region. The pressure differential may be continuous or established at different levels to achieve desired results, e.g. release of the locking mechanism to enable actuation of the liner hanger while also allowing release of the liner hanger running tool. By way of example, the pressure differential may be used to first set the liner hanger and to subsequently release the running string for removal.

Referring generally to FIG. 1, an example of a liner hanger system 30 is illustrated as being run-in-hole into a borehole 32, e.g. a wellbore, lined with or otherwise having a casing 34. In this embodiment, the liner hanger system 30 comprises a liner hanger assembly 36 having tubing 38, e.g. a liner string, coupled with a liner hanger 40. The overall liner hanger system 30 further comprises a releasable running string 42 which is releasably coupled with the liner hanger assembly 36. The liner hanger 40 works in cooperation with an anti-preset module 44 to prevent premature actuation/setting of the liner hanger 40 into engagement with the surrounding casing 34.

Depending on the parameters of a given operation, the liner hanger system 30 also may comprise other components/assemblies enabling interaction between the liner hanger assembly 36 and the running string 42. For example, the overall liner hanger system 30 may further comprise a pack off coupling section 46, a collet running tool (CRT) section 48, and a packer section 50. The packer section 50 may include a liner top packer assembly having a packer 52 which is part of or combined with the overall liner hanger assembly 36. In the illustrated example, the packer 52 is part of the liner hanger assembly 36 and is located below the collet running tool section 48 and above the liner hanger 40. The packer section 50 may have a variety of configurations and may comprise various slips, sealing elements, and other components to facilitate actuation and engagement with the surrounding casing 34.

In the illustrated example, the liner hanger 40 comprises various features such as a cone 54 having inclined surfaces which interact with slips 56. The slips 56 may be coupled with one or more hydraulic cylinders 58. Once the liner hanger 40 is released for actuation via the anti-preset module 44, pressure applied down through the running string 42 may be used to actuate at least one of the cylinders 58 so as to shift the slips 56 linearly with respect to the cone 54. This relative linear movement of the slips 56 against the sloped surfaces of cone 54 effectively forces the slips 56 in a radially outward direction and ultimately into secure engagement with the surrounding casing 34.

Figure 2:
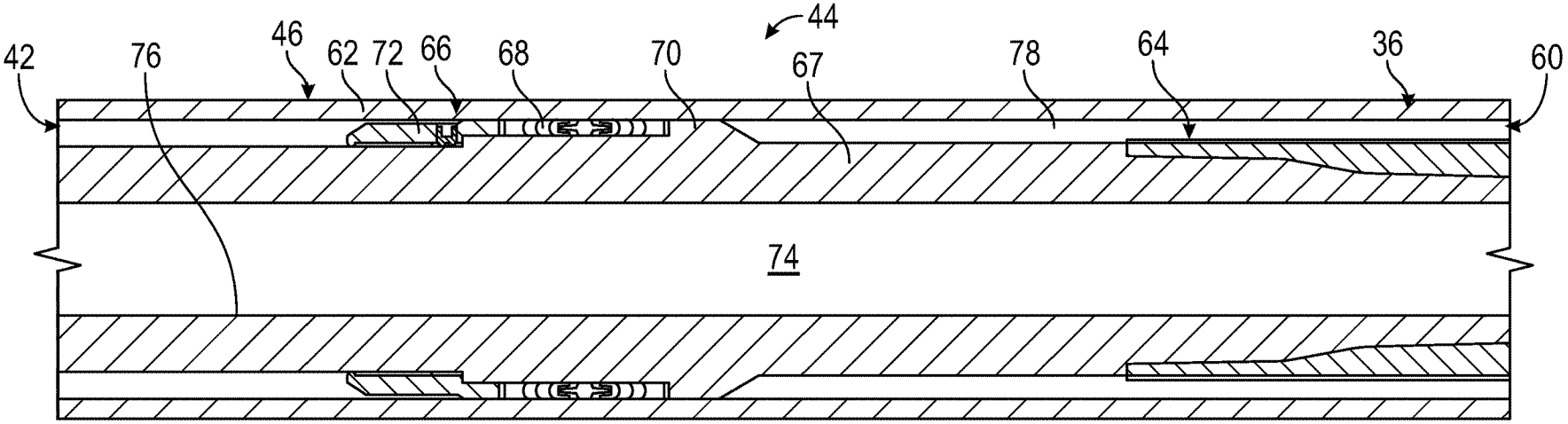
FIG. 2 is a cross-sectional illustration of a portion of the liner hanger system illustrated in FIG. 1 showing an example of a pack off coupling section, according to an embodiment of the disclosure.

Referring generally to FIG. 2, a cross-sectional illustration of the pack off coupling section 46 is illustrated. In this example, the running string 42 comprises a running tool 60, a portion of which is illustrated in cross-section in FIG. 2. The running tool 60 is disposed within a tubular section 62, e.g. a tieback receptacle, of the overall liner hanger assembly 36. By way of example, the illustrated portion comprises a mandrel 64 and at least a portion of a pack off coupling 66 coupled to the running tool 60 as part of the running string 42. The pack off coupling 66 includes a pack off coupling mandrel 67 which forms part of the overall mandrel 64. A seal 68 surrounds pack off coupling mandrel 67 and is captured linearly between an abutment 70 and a retention mechanism 72. The seal 68 is positioned to form a seal between the mandrel 67 and the surrounding tubular section/tieback receptacle 62. It should be noted that seal 68 of pack off coupling 66 could be an integral component of running tool 60.

As illustrated, the configuration provides an inner pressure region 74 within the running tool 60, e.g. within an internal passage 76 of the running tool 60, and an intermediate pressure region 78. The intermediate pressure region 78 is located between the running tool 60 and the liner hanger assembly 36. It should be noted the internal passage 76 extends down through the running tool 60 and enables circulation of fluids under relatively high pressure during running-in-hole. However, the internal passage 76 also effectively is in communication with the intermediate pressure region 78 located externally of the running tool 60 and within the liner hanger assembly 36. For example, the pressure regions 74, 78 may be in communication with each other around a bottom end of the running tool 60 and/or via suitably located ports. This allows the inner pressure region 74 to remain substantially pressure balanced with the intermediate pressure region 78 below pack off coupling 66 while running-in-hole. The pressure balancing helps reduce the chance of premature actuation of the liner hanger 40 and/or premature release of the running string 42 from the liner hanger assembly 36.

Figure 3:
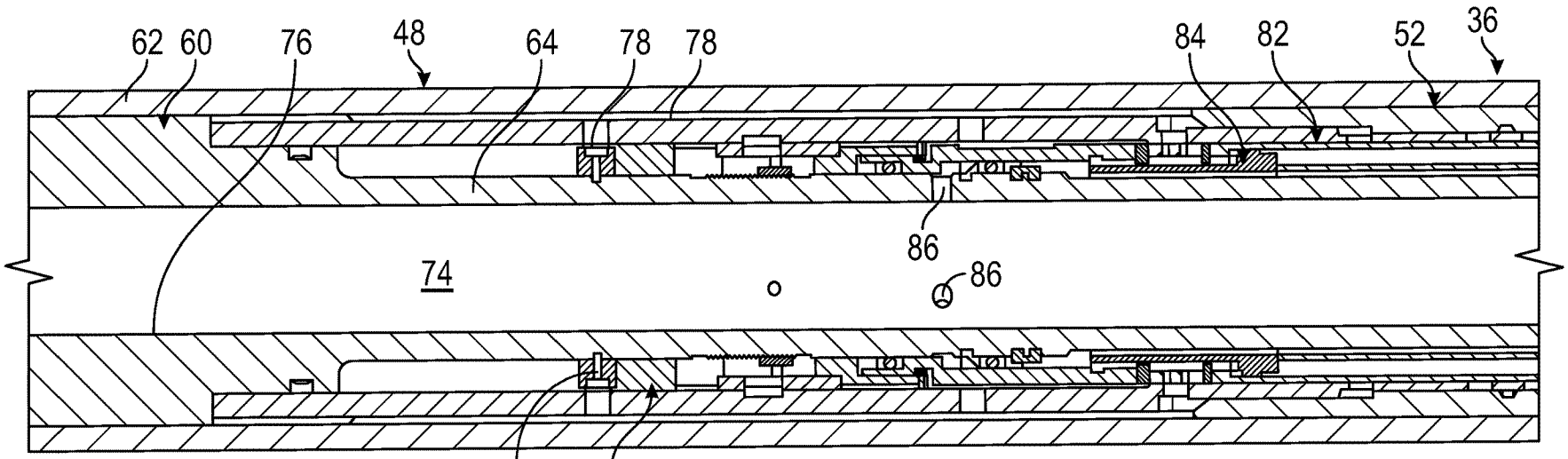
FIG. 3 is a cross-sectional illustration of a portion of the liner hanger system illustrated in FIG. 1 showing an example of a collet running tool (CRT) section for releasing a packer, according to an embodiment of the disclosure.

Referring generally to FIG. 3, an example of CRT section 48 is illustrated. In this embodiment, the running tool 60 of running string 42 may be coupled with the liner hanger assembly 36 at CRT section 48. As illustrated, the CRT section 48 may comprise a CRT piston 80 slidably mounted around running tool mandrel 64. The CRT piston 80 is operatively coupled with packer 52 via a collet 82 and connector mechanism 84, thus connecting the running string 42 to liner hanger assembly 36. While inner pressure region 74 is open, pressure cannot build to shift the CRT piston 80. Therefore, running string 42 and packer 52 are not prematurely released. Effectively, the structure of CRT piston 80 and the overall CRT section 48 allows the pass-through of pressure along intermediate pressure region 78 and up to pack off coupling 66. This allows pressure to equalize between pressure regions 74 and 78, thus preventing premature release of piston 80 and running string 42. It should be noted that collet running tool section 48 could be constructed as a different type of running tool section, e.g. a hydraulic running tool section using a hydraulic running tool or a hydro mechanical running tool section using a hydro mechanical running tool instead of a collet running tool.

However, once the inner pressure region 74 is blocked (e.g. by dropping a ball as explained in greater detail below), increased pressure may be applied along inner pressure region 74 relative to pressure region 78. This increased pressure acts on CRT piston 80 via passages 86. Sufficient pressure in inner pressure region 74 relative to intermediate pressure region 78 causes the CRT piston 80 to shift linearly along mandrel 64 (shift to the left in the example illustrated in FIG. 3) which, in turn, shifts collet 82 via mechanism 84 to a release position. Shifting the collet 82 to the release position also releases packer 52 and running string 42. After the packer 52 and running string 42 are released, the packer 52 may be set by, for example, mechanically slacking off weight on the string and thus slacking off weight on the packer 52. Additionally, the running string 42 may be withdrawn to the surface. It should be noted that some embodiments may utilize a shear member 88, e.g. shear screws, which initially hold CRT piston 80 in place until sufficient pressure builds along inner pressure region 74.

Figure 4:
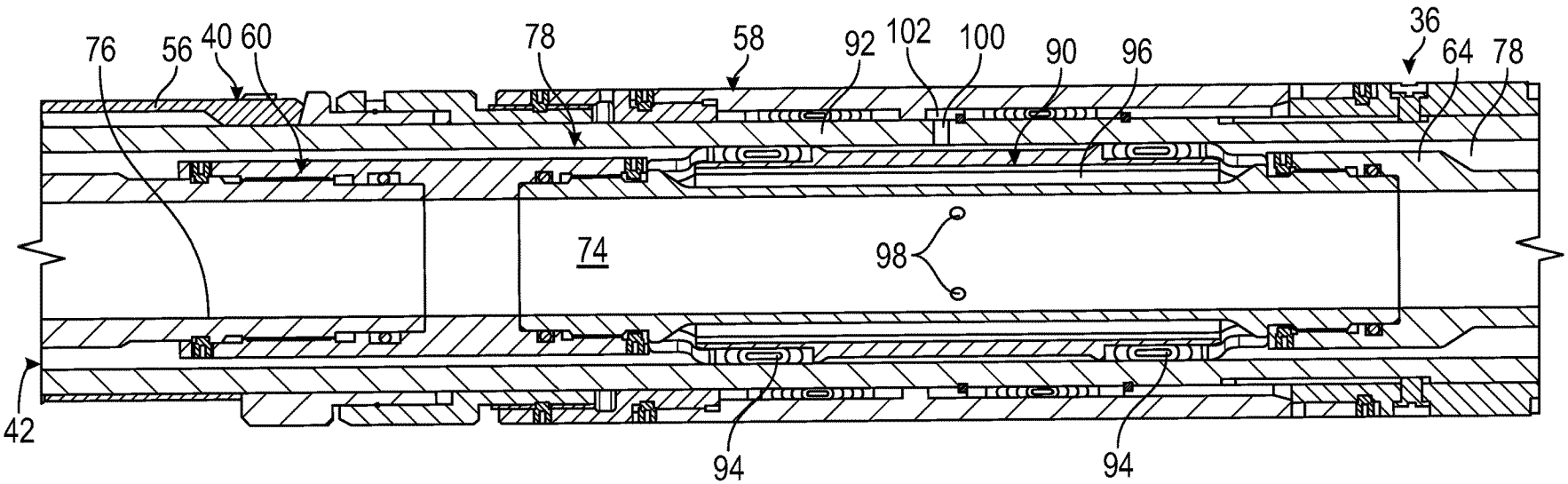
FIG. 4 is a cross-sectional illustration of a portion of the liner hanger system illustrated in FIG. 1 showing an example of a liner hanger section having a liner hanger disposed about a running tool, according to an embodiment of the disclosure.
Figure 5:
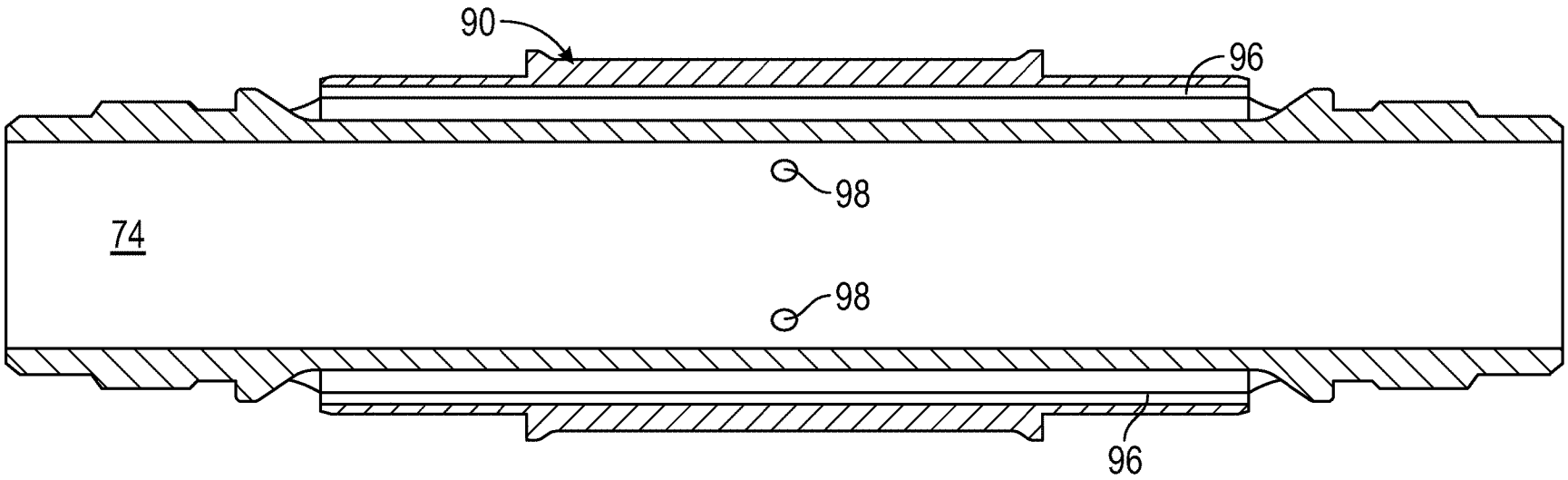
FIG. 5 is a cross-sectional illustration of an example of a bypass module, according to an embodiment of the disclosure.
Figure 6:
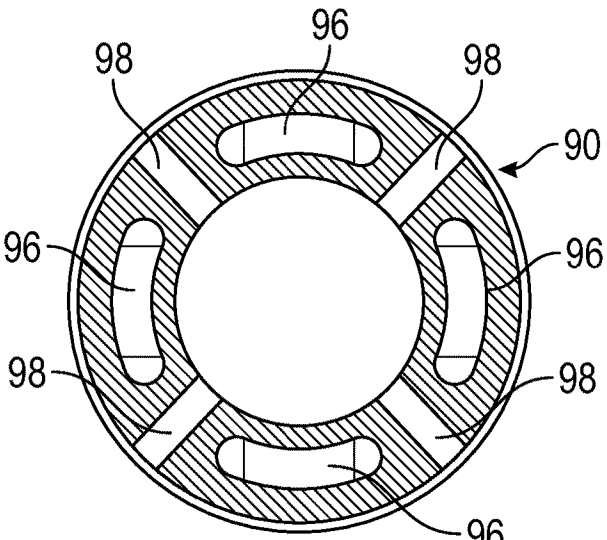
FIG. 6 is a cross-sectional illustration of the bypass module illustrated in FIG. 5 taken transversely through the bypass module to illustrate separation of bypass passages and pressure actuation passages, according to an embodiment of the disclosure.

Referring generally to FIGS. 4-7, an example is illustrated of the anti-preset module 44 and liner hanger setting features. In FIG. 4, for example, a portion of the running tool 60 is illustrated as having a bypass module 90 disposed generally within one of the cylinders 58, e.g. the upper of the two illustrated cylinders 58. However, the bypass module 90 may be located at other positions. In the illustrated example, the bypass module 90 is sealably engaged with a surrounding tubular structure 92 of liner hanger assembly 36 via seals 94. As illustrated, the tubular structure 92 may be positioned along the interior of cylinders 58.

The bypass module 90 comprises longitudinal passages 96 which extend in a generally axial direction past seals 94 so as to allow pressure equalization between the inner pressure region 74 and the overall intermediate pressure region 78 above and below seals 94. However, the bypass module 90 also comprises radially oriented ports or passages 98 extending between inner pressure region 74 and intermediate pressure region 78. As further illustrated in FIGS. 5 and 6, the radial passages 98 are located so as to remain isolated with respect to the longitudinal bypass passages 96. It should be noted that corresponding passages 100, e.g. radial passages, are formed through tubular structure 92 to enable communication between intermediate pressure region 78 and an actuation region 102 of at least one corresponding hydraulic cylinder 58, e.g. the upper cylinder 58. As explained in greater detail below, once flow along inner pressure region 74 is blocked, the pressure within region 74 may be increased. This relatively increased pressure is translated through passages 98, through corresponding passages 100, and into actuation region 102. Sufficient pressure is able to cause linear shifting of the corresponding cylinder(s) 58, relative to tubular structure 92, and thus actuation of slips 56 to set liner hanger 40.

Figure 7:
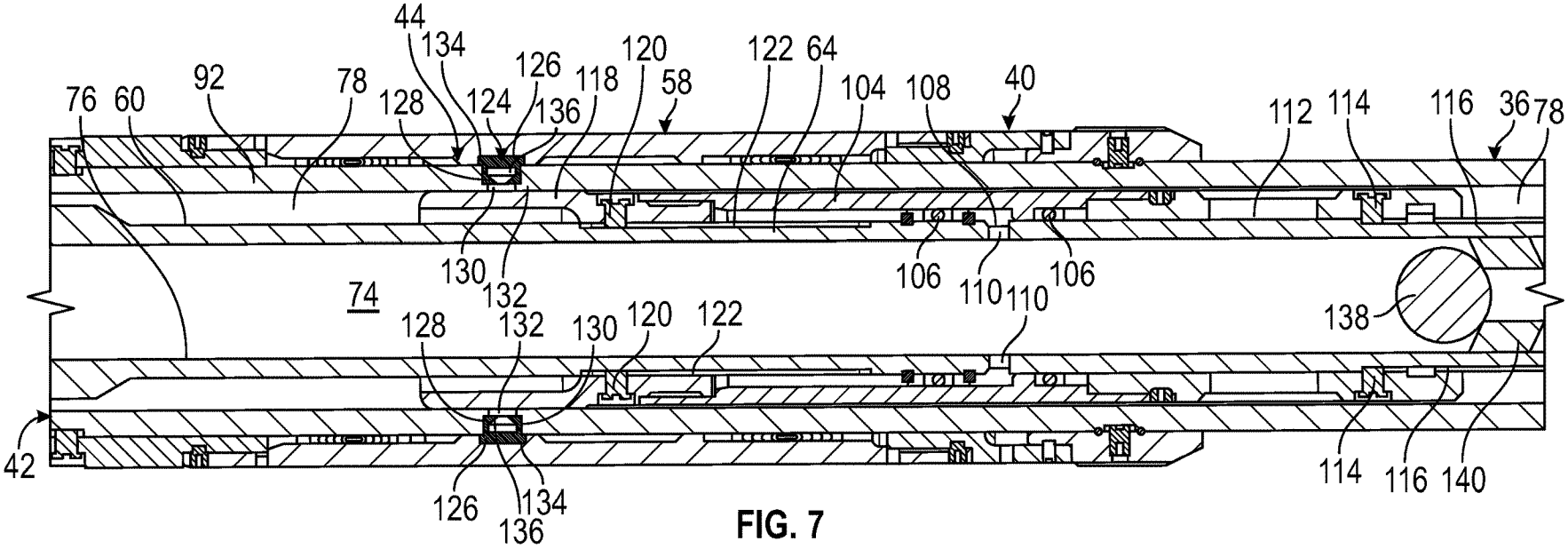
FIG. 7 is a cross-sectional illustration of a portion of the liner hanger system illustrated in FIG. 1 showing an example of an anti-preset module including a releasable locking mechanism, according to an embodiment of the disclosure.

With additional reference to FIG. 7, an example of the anti-preset module 44 is illustrated as comprising a module piston 104 slidably mounted around running tool mandrel 64. Appropriate seals 106 are positioned between module piston 104 and mandrel 64 to form an actuation chamber 108 which is in fluid communication with inner pressure region 74 via at least one passage 110, e.g. a plurality of radial passages.

The module piston 104 may be connected with a lower sleeve 112 slidably connected and rotationally restricted via a pin or pins 114 slidably received in a corresponding slot or slots 116 formed along the exterior of mandrel 64. Similarly, the module piston 104 is illustrated as connected with an upper sleeve 118 slidably connected and rotationally restricted via a pin or pins 120 slidably received in a corresponding slot or slots 122.

In this embodiment, the anti-preset module 44 further comprises a locking mechanism 124 which locks the liner hanger 40 against actuation while, for example, running-in-hole. By way of example, the locking mechanism 124 may comprise a plurality of dogs 126 mounted in and retained in the liner hanger 40. For example, the dogs 126 may be mounted in corresponding recesses 128 formed along the exterior of tubular structure 92. The dogs 126 each include a base portion 130 which extends through a corresponding opening 132 formed radially through tubular structure 92 (see also FIG. 8).

Prior to actuation of liner hanger 40, e.g. during running-in-hole, the base portion 130 of each dog 126 is in contact with an exterior surface of upper sleeve 118. The upper sleeve 118 holds each of the dogs 126 in a radially extended position and in engagement with a corresponding retention recess 134 located along an interior of the corresponding cylinder 58, e.g. the lower of the two illustrated cylinders 58, thus preventing linear movement of the corresponding cylinder 58 in a liner actuation direction. Additionally, each dog 126 may be spring biased in the radially outward direction by, for example, a suitable spring member 136.

Once the liner hanger 40 is at a desired position for setting of slips 56, a ball 138 is dropped down through the internal passage 76 of running string 42 and running tool 60 until engaging a corresponding ball seat 140 to prevent flow along internal passage 76. It should be noted that ball 138 is used broadly to refer to an item able to block flow along internal passage 76; and ball 138 may have a variety of shapes and configurations, e.g. partial balls, darts, and various other plugs.

After the ball 138 is seated against corresponding ball seat 140, pressure may be increased along inner pressure region 74 to establish a pressure differential (delta P) between the inner pressure region 74 and the intermediate pressure region 78. The increased pressure within inner pressure region 74 acts against module piston 104 via passages 110. Upon sufficiently increased pressure, the module piston 104 is shifted linearly (to the right in the example illustrated in FIGS. 7 and 8) which, in turn, shifts upper sleeve 118 away from the corresponding dogs 126 so as to release the dogs 126 as illustrated in FIG. 8.

Figure 9:
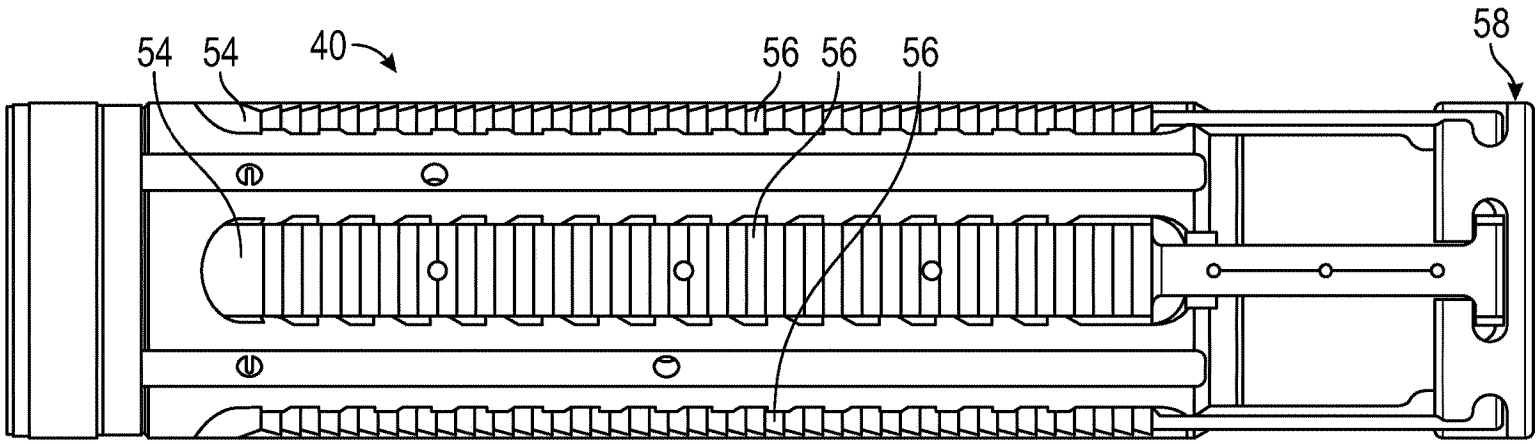
FIG. 9 is an illustration of a portion of the liner hanger showing liner slips prior to actuation, according to an embodiment of the disclosure.
Figure 10:
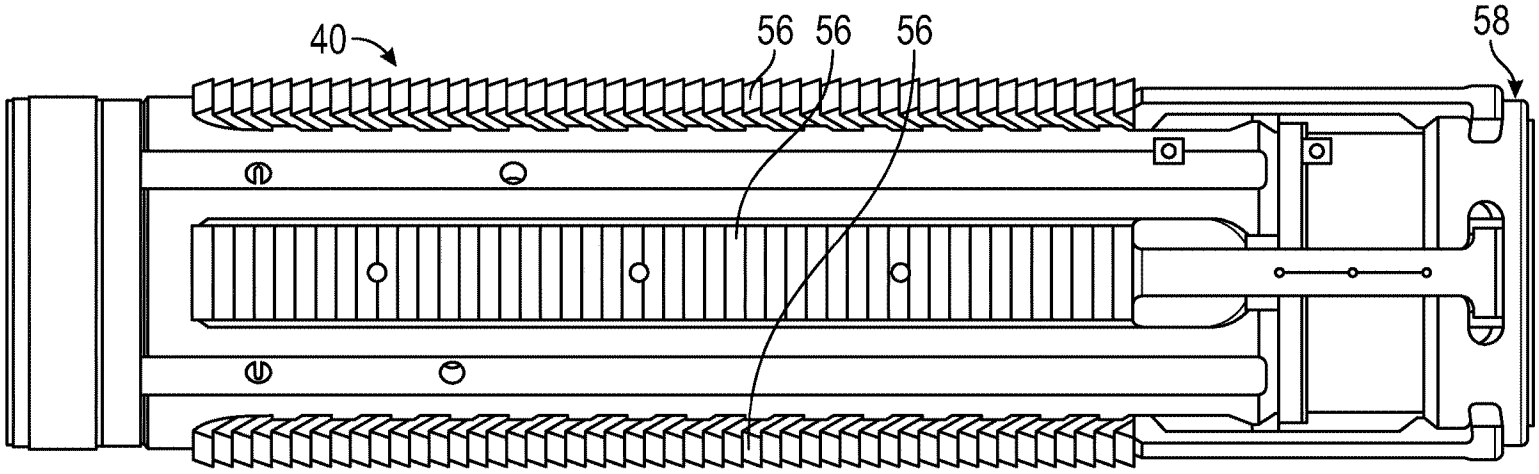
FIG. 10 is an illustration similar to that in FIG. 9 but showing the liner slips in an actuated, set position once the liner hanger has been actuated following release of the releasable locking mechanism located in the anti-preset module, according to an embodiment of the disclosure.

Simultaneously, the increased pressure within pressure region 74 is able to act against the appropriate corresponding cylinder 58, e.g. the upper cylinder 58, via passages 98 and 100 (see FIG. 4). Because the corresponding dogs 126 are no longer locking the lower hydraulic cylinder 58 in place relative to tubular structure 92, sufficiently increased pressure is able to shift both cylinders 58 linearly along tubular structure 92. The linear shifting of the cylinders 58 causes the liner hanger slips 56 to shift from a radially contracted position (see FIG. 9) to a radially expanded configuration (see FIG. 10) for gripping engagement with the surrounding casing 34.

Figure 8:
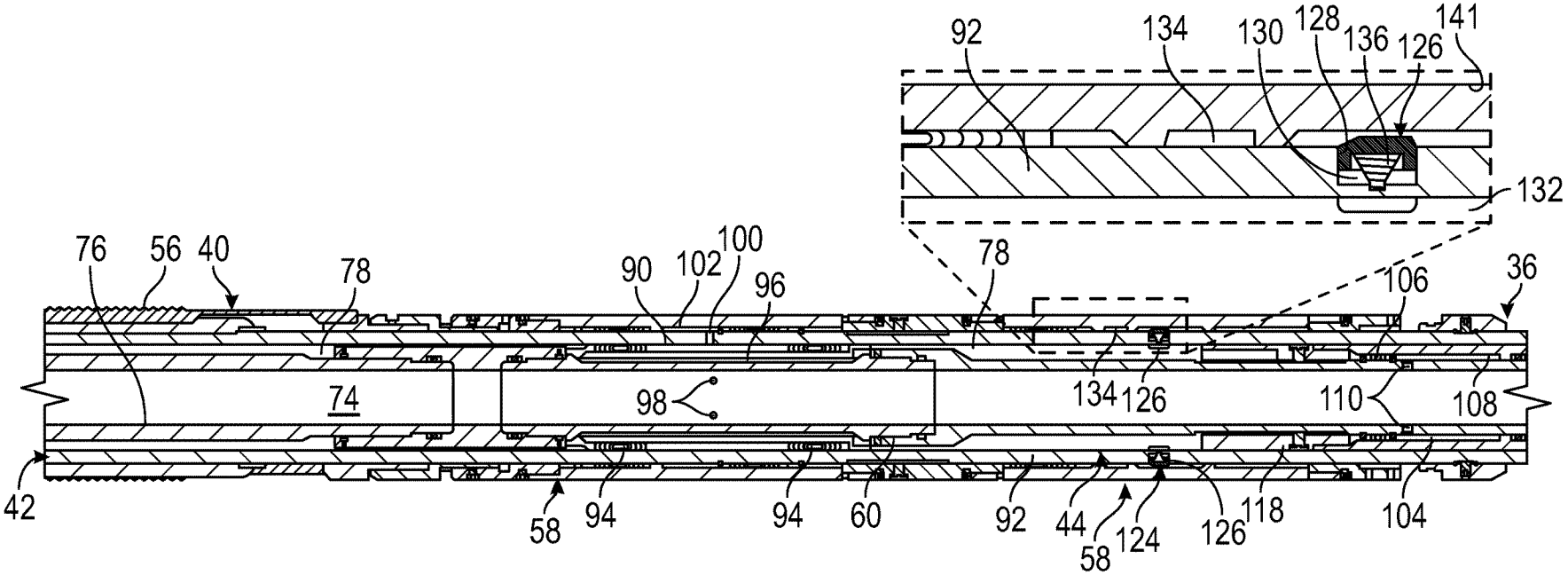
FIG. 8 is a cross-sectional illustration of the anti-preset module after release of the releasable locking mechanism to enable shifting of the liner hanger to an actuated configuration, according to an embodiment of the disclosure.

As illustrated in FIG. 8, the interior of the corresponding cylinder 58 surrounding locking dogs 126 also may comprise relief recesses 141 which enable spring members 136 to once again bias the dogs 126 in a radial outward direction after actuation of the liner hanger 40. This allows the dogs 126 to be shifted entirely out of the internal passage 76 to eliminate obstructions.

After setting the liner hanger 40, continued application of pressure along internal passage 76 (or sufficiently increased pressure along internal passage 76) enables shifting of CRT piston 80 so as to release collet 82, thus releasing packer 52 and running string 42 (see FIG. 3). Release of the packer 52 enables setting of the packer 52 via, for example, slacking off weight. Also, the running tool 60 and overall running string 42 may be withdrawn from the liner hanger assembly 36 and retrieved to the surface. In this example, dropping of ball 138 allows establishment of sufficient pressure differential(s) between inner pressure region 74 and intermediate pressure region 78 so as to enable sequential setting of liner hanger 40 and then release of packer 52 and running string 42. Subsequently, the ball 138 and ball seat 140 may be removed from internal passage 76 by applying increased pressure to shear the ball seat 140 for removal. (However, other suitable mechanisms may be used to release the ball 138 and ball seat 140 from internal passage 76.)

Figure 11:
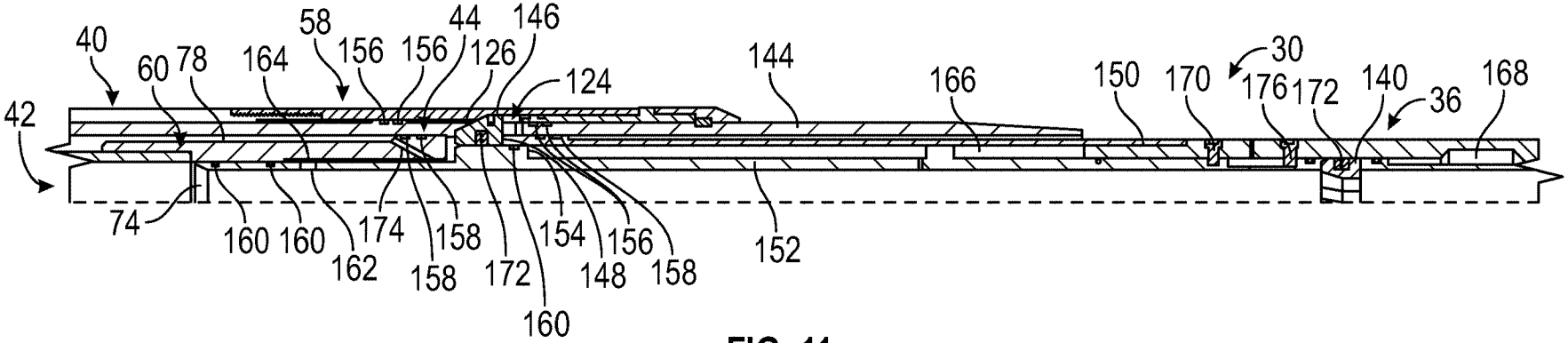
FIG. 11 is a cross-sectional illustration of a portion of another embodiment of a liner hanger system utilizing another type of anti-preset module in a run in hole configuration, according to an embodiment of the disclosure.
Figure 12:
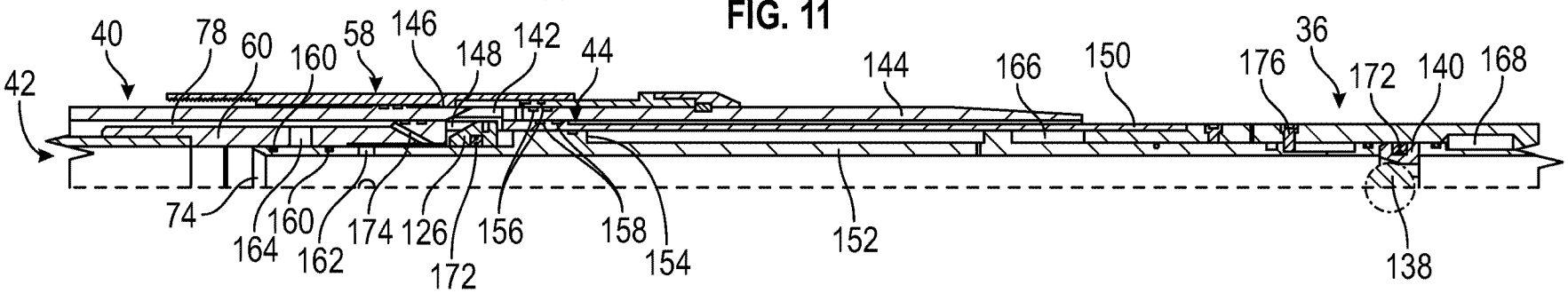
FIG. 12 is a cross-sectional illustration similar to that of FIG. 11 but with the liner hanger system shifted to a liner hanger set configuration, according to an embodiment of the disclosure.
Figure 13:
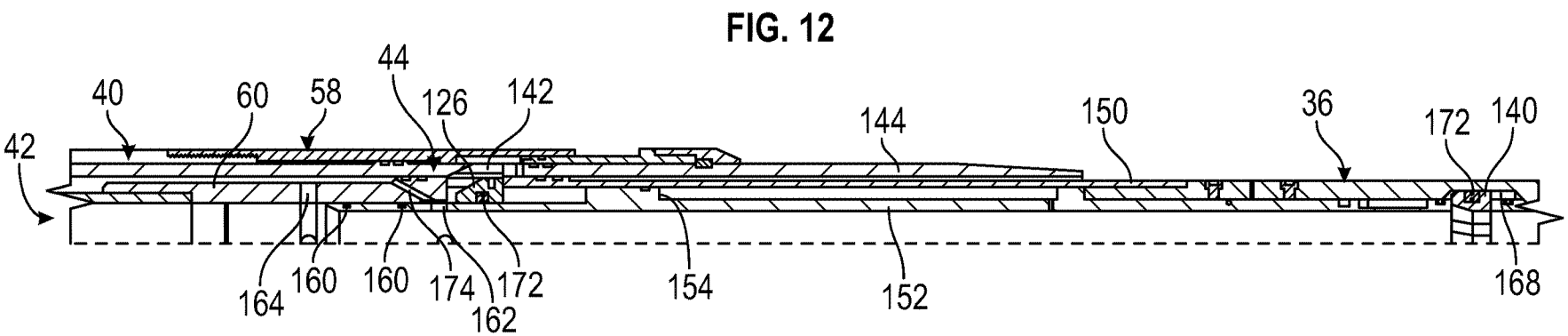
FIG. 13 is a cross-sectional illustration similar to that of FIG. 12 but with the liner hanger system shifted to a running tool release configuration, according to an embodiment of the disclosure.

Referring generally to FIGS. 11-13, another example of the liner hanger system 30 and its anti-preset module 44 is illustrated. In this embodiment, the anti-preset module 44 once again comprises locking mechanism 124 which may utilize a plurality of the locking dogs 126. However, in this configuration the locking dogs 126 are positioned on running tool 60 for engagement with the corresponding hydraulic cylinder 58 through corresponding openings 142 formed through a liner hanger body 144 of liner hanger 40.

Prior to setting of the liner hanger 40, the locking dogs 126 are positioned in a radially extended configuration, through corresponding openings 142, and into engagement with an interior of the corresponding cylinder 58. By way of example, the interior of the corresponding cylinder 58 may have an abutment 146 which prevents linear movement of the corresponding cylinder 58 in an axial direction, e.g. in an upward direction, thus preventing premature actuation of liner hanger 40.

According to the embodiment illustrated, the locking dogs 126 are held in radial openings 148 of a lock dog housing 150 and maintained in the radially outward, locked position by a lock dog support sleeve 152. For example, the lock dog support sleeve 152 may comprise an enlarged diameter portion 154 which maintains the locking dogs 126 in the radially outward, locked position when portion 154 is located along the inner surface of the locking dogs 126.

As illustrated, seals 156 may be positioned between liner hanger body 144 and corresponding cylinder 58 on both upper and lower sides of openings 142. Similarly, seals 158 may be positioned between lock dog housing 150 and liner hanger body 144 on both upper and lower sides of radial openings 148. Additionally, suitably located seals 160 may be positioned between lock dog support sleeve 152 and lock dog housing 150.

While the anti-preset module 44 is in the run-in-hole position illustrated in FIG. 11, a support sleeve port or ports 162 remain in alignment with corresponding port or ports 164 through lock dog housing 150. The aligned ports 162 and 164 enable pressure equalization between inner pressure region 74 and intermediate pressure region 78 so as to avoid premature pressure differentials which could otherwise actuate the liner hanger 40. Additionally, the locking dogs 126 prevent premature actuation. It should be noted that the anti-preset module 44 may comprise various other components and features, such as the dampening chambers 166 and 168 which can be arranged to dampen shifting of the components during actuation.

In FIG. 12, a hanger setting configuration is illustrated. In this configuration, ball 138 has been dropped down through internal passage 76 and into engagement with ball seat 140. By way of example, ball seat 140 may be a segmented ball seat releasably secured to lock dog support sleeve 152.

To actuate the liner hanger 40, the ball 138 is landed on ball seat 140 and pressure is increased in inner pressure region 74 relative to intermediate pressure region 78 until a first set of shear screws 170 is sheared. This allows the lock dog support sleeve 152 to shift relative to lock dog housing 150, e.g. to move in a downwards direction or to the right in FIG. 12. This movement of lock dog support sleeve 152 also shifts enlarged diameter portion 154 from under the locking dogs 126 so that locking dogs 126 may retract inwardly. The radially inward movement of locking dogs 126 releases them from the corresponding cylinder 58. In some embodiments, magnets 172 or other biasing mechanisms may be used to help draw the locking dogs 126 in a radially inward direction.

At the same time, the support sleeve ports 162 are moved out of alignment with corresponding ports 164; and seals 160 are positioned to straddle and isolate the corresponding pressure equalization ports 164. It should be noted that a check valve 174 may be positioned in a corresponding passage extending generally radially through lock dog housing 150 to ensure there remains no trapped pressure in intermediate pressure region 78, e.g. in the space between the running tool 60 and the liner hanger body 144.

Once the corresponding ports 164 are isolated, the pressure applied along inner pressure region 74 is able to move through ports 162, through radial openings 148, and through corresponding openings 142 to shift the corresponding cylinder 58, as illustrated in FIG. 12. By continuing to increase the pressure along inner pressure region 74, the running tool 60 may be released and a second set of shear screws 176 may be sheared to thus allow shifting of the segments of ball seat 140, as illustrated in FIG. 13. By way of example, the segments of ball seat 140 may be shifted into a suitable recess such as dampening chamber 168. In some embodiments, the segments of ball seat 140 may include magnets 172 or other biasing mechanisms to help ensure the segments remain in dampening chamber 168. After removal of the running tool 60, additional operations, e.g. cementing operations, may be performed.

It should be noted the liner hanger assembly 36 and running string 42 may be constructed in various sizes and configurations. Additionally, each of these components of the overall liner hanger system 30 may utilize various engagement features, seals, flow port arrangements, flow passages, and/or other features to enable the desired operation. For example, various flow passage arrangements may be used to achieve the desired equalization of pressures between the inner pressure chamber and the intermediate pressure chamber. Additionally, various types of balls may be used or other types of mechanisms may be used to enable selective achievement of the pressure differentials for releasing the anti-preset module, for actuating the liner hanger, and/or for releasing the running tool.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a running tool;

a liner hanger assembly coupled with the running tool for conveyance to a desired location in a borehole, the liner hanger assembly comprising:

a packer;

a liner hanger actuatable between a radially contracted position and a radially expanded set position by applying a sufficient pressure differential between an inner pressure region and an intermediate pressure region; and a ball seat positioned to receive a ball blocking communication between the inner pressure region and the intermediate pressure region to enable application of the sufficient pressure differential; and an anti-preset module comprising a locking mechanism mounted on the liner hanger assembly and a sleeve mounted in the running tool, the locking mechanism being held in place by the sleeve to lock the liner hanger against actuation, the sleeve being shiftable to release the locking mechanism in response to buildup of the sufficient pressure differential, wherein the locking mechanism comprises a plurality of lock dogs held in a radially outward locked position by the sleeve, and wherein the lock dogs of the plurality of lock dogs are held in engagement with an internal surface of a hydraulic actuation cylinder of the liner hanger when in the locked position.

2. The system as recited in claim 1, further comprising a pack off coupling, located along the intermediate pressure region above the packer, and a running tool section arranged to facilitate initial pressure balancing between the inner pressure region and the intermediate pressure region to prevent premature release of the packer and the running tool.

3. The system as recited in claim 1, wherein pressure buildup in the inner pressure region after engagement of the ball with the ball seat causes setting of the liner hanger followed by setting of the packer and release of the running tool.

4. The system as recited in claim 1, wherein the lock dogs of the plurality of lock dogs are spring biased in a radially outward direction.

5. The system as recited in claim 1, wherein the sleeve is coupled with a shiftable piston.

6. The system as recited in claim 5, wherein the shiftable piston is mounted around a mandrel.

7. The system as recited in claim 6, wherein the shiftable piston is prevented from rotating with respect to the mandrel.

8. The system as recited in claim 1, wherein the packer also is released via buildup of a pressure differential between the inner pressure region and the intermediate pressure region.

9. A method, comprising:

deploying a liner hanger assembly downhole via a running tool;

locking a liner hanger of the liner hanger assembly in a radially collapsed configuration via a locking dog mounted in and retained by the liner hanger, wherein the locking of the liner hanger comprises:

using a plurality of the locking dogs held in a radially outward position to block actuation of the liner hanger; and holding the plurality of the locking dogs in engagement with an inner surface of a corresponding hydraulic cylinder of the liner hanger via a sleeve coupled to a piston of the running tool;

dropping a ball down to a ball seat in the liner hanger assembly to enable creation of a pressure differential between an inner pressure region of the running tool and an intermediate pressure region surrounding the running tool; and using the pressure differential to shift the piston of the running tool so as to release the locking dog.

10. The method as recited in claim 9, wherein using the pressure differential further comprises actuating the liner hanger to a set position in a borehole.

11. The method as recited in claim 10, wherein using the pressure differential further comprises subsequently releasing the running tool from the liner hanger assembly.

12. The method as recited in claim 10, wherein using the pressure differential further comprises releasing a packer of the liner hanger assembly to enable setting of the packer by slacking off weight on the packer.

13. The method as recited in claim 9, wherein the locking dogs of the plurality of the locking dogs are spring biased in a radially outward direction.

14. A system, comprising:

a running tool;

a liner hanger assembly coupled with the running tool for conveyance to a desired location in a borehole, the liner hanger assembly comprising:

a liner hanger actuatable between a radially contracted position and a radially expanded set position by applying a sufficient pressure differential between an inner pressure region and an intermediate pressure region;

a ball seat positioned to receive a ball blocking communication between the inner pressure region and the intermediate pressure region to enable application of the sufficient pressure differential; and a check valve positioned to bleed off excess pressure in the intermediate pressure region; and an anti-preset module comprising a locking mechanism mounted in the running tool, the locking mechanism being held in place by a lock dog support sleeve to lock the liner hanger against actuation, the lock dog support sleeve being shiftable to release the locking mechanism in response to buildup of the sufficient pressure differential, wherein the locking mechanism comprises a plurality of lock dogs held radially outward in a locked position via an expanded diameter portion of the lock dog support sleeve, and wherein the lock dogs of the plurality of lock dogs are held against an internal surface of a hydraulic actuation cylinder of the liner hanger when in the locked position.

15. The system as recited in claim 14, wherein the anti-preset module comprises shear screws which initially resist movement of the lock dog support sleeve.

16. The system as recited in claim 14, wherein the ball seat is a segmented ball seat which may be shifted to a recess after use of the sufficient pressure differential.

17. The system as recited in claim 14, wherein the lock dogs of the plurality of lock dogs are spring biased in a radially outward direction.

* * * * *